US005493766A

United States Patent [19]

Yamakawa et al.

[11] Patent Number: 5,493,766

[45] Date of Patent: Feb. 27, 1996

[54] PROCESS FOR HOT WORKING CONTINUOUS-CAST BLOOM AND STEEL INGOT

[75] Inventors: Shin-ichiro Yamakawa; Takeshi Hanada; Toshiyuki Tsuge; Kenichi Takakura; Masahiro Takeda; Kenzo Yamaguchi; Takemi Suzuki, all of Aichi, Japan

[73] Assignee: Aichi Steel Works, Ltd., Aichi, Japan

[21] Appl. No.: 118,217

[22] Filed: Sep. 9, 1993

[30] Foreign Application Priority Data

Sep. 9, 1992 [JP] Japan ..... 4-266615

[51] Int. Cl.[6] ..... B21B 1/00

[52] U.S. Cl. ..... 29/527.7; 29/527.5; 148/541; 164/476

[58] Field of Search ..... 148/541; 164/476; 29/527.7

[56] References Cited

U.S. PATENT DOCUMENTS

| | | | |
|---|---|---|---|
| 4,738,301 | 4/1988 | Ueshima et al. | 148/541 |
| 4,809,765 | 3/1989 | Veshima et al. | 148/541 |
| 4,994,118 | 2/1991 | Pircher et al. | 148/541 |
| 5,030,296 | 7/1991 | Ueda et al. | 148/541 |
| 5,092,393 | 3/1992 | Suehiro et al. | 164/476 |

FOREIGN PATENT DOCUMENTS

| | | | |
|---|---|---|---|
| 2294236 | 7/1976 | France . | |
| 2350144 | 5/1974 | Germany . | |
| 1264135 | 11/1986 | Japan | 148/541 |
| 62-212001 | 9/1987 | Japan | 29/527.7 |
| 62-224401 | 10/1987 | Japan | 29/527.7 |
| 63-168260 | 7/1988 | Japan . | |
| 2-267227 | 11/1990 | Japan | 148/541 |
| 3-138055 | 6/1991 | Japan | 148/541 |
| 4-235219 | 8/1992 | Japan | 148/541 |

OTHER PUBLICATIONS

Patent Abstracts of Japan, vol. 17, No. 271 (M–1417) 26 May 1993.

Database WPI, Week 8449, Derwent Publications Ltd., London, GB; AN 84–303635.

Database WPI, Week 7412, Derwent Publications Ltd., London, GB; AN 74–21985V.

Patent Abstracts of Japan, vol. 12, No. 434 (M–764)(3281) 1988.

Patent Abstracts of Japan, vol. 10, No. 71 (C–334)(2128) 1986.

*Primary Examiner*—Carl J. Arbes

*Attorney, Agent, or Firm*—Sughrue, Mion, Zinn, Macpeak & Seas

[57] ABSTRACT

A process for hot working a continuous-cast bloom or a steel ingot, the process comprising the steps of: (1) cooling a bloom produced by continuous casting or a steel ingot produced with a mold to bring the surface temperature thereof to 50° to 150° C. higher than the $Ar_3$ transformation point thereof; (2) quenching the bloom or the steel ingot in such a way that its interior remains red hot while the surface is transformed to have a bainite structure; and (3) heating the bloom or the steel ingot in a furnace followed by hot shaping.

4 Claims, 1 Drawing Sheet

PROCESS FOR HOT WORKING CONTINUOUS-CAST BLOOM AND STEEL INGOT

FIELD OF THE INVENTION

The present invention relates to a process for hot working blooms produced by continuous casting and steel ingots produced with molds. The process is intended for effective use of the latent heat in cast blooms or steel ingots, and in particular, for preventing surface cracks that occur frequently in cast blooms and ingots of aluminum killed steel as they are worked by hot rolling.

BACKGROUND OF THE INVENTION

It is generally known that when soaked steel ingots are primary-rolled into semifinished products called blooms, slabs and billets, various types of cracking occur depending upon such factors as the composition of the ingot, its structure, heating profile and rolling conditions. A transversal cracking phenomenon, which develops in steel ingots during the rolling process, is characteristic in aluminum deoxidized low- and medium-carbon steels and low-alloy steels; transversal cracking is detrimental to rolling operations and reduces their yield so much as to cause great economic loss.

Steel ingots withdrawn from molds are first heated in a heating furnace to the proper temperature for primary rolling, and from the viewpoint of steel manufacture process, the withdrawn ingot is subjected to one of the following conditions before it is charged into the heating furnace:

(i) neither the interior nor the surface area of the ingot cools down excessively but they are held at a temperature significantly higher than the $Ar_3$ transformation point while the ingot is charged into the heating furnace;

(ii) the temperature of the ingot in its surface area has lowered just above the $Ar_3$ transformation point, namely, the overall ingot temperature is lower than in the above conditions (i) but the ingot is still austenitic while it is charged into the heating furnace; or (iii) the withdrawn ingot is cooled slowly so that not only its surface area but also the whole ingot cools down below the $Ar_1$ transformation point, sometimes close to ordinary temperatures, and the thus cooled ingot which is generally referred to as a "cold ingot" is charged into the heating furnace where it is heated to the rolling temperature.

Steel ingots to be rolled are charged into the heating furnace under one of these three conditions depending upon the weight and shape of the ingot, the temperature at which it is withdrawn from the mold, and the time to charging into the heating furnace. The risk of cracking is small during the rolling of the ingot that has been charged into the heating furnace in accordance with the conditions (i); on the other hand, almost all reported cases of transversal cracking are associated with the conditions (ii). No case has been known that transversal cracking occurred during the rolling of ingots treated under the conditions (iii).

The above shows both statistically and experimentally that the occurrence of transversal cracking depends on the manner in which ingots withdrawn from the mold are charged into the heating furnace. In other words, the transversal cracking of ingots is the least associated with factors in steel manufacturing, heating and rolling processes but is governed most by the profile of temperature drop which the ingot experiences after it is withdrawn from the mold and before it is charged into the heating furnace.

JP-B-49-7771 discloses, as a result of the above finding concerning the operation of rolling steel ingots, a method of hot working a steel ingot, in which the ingot is immersed in a circulating coolant in a vessel or sprayed with a propelled coolant in such a rapid manner that the interior of the ingot remains red hot while only its surface layer is cooled down below the $A_1$ transformation temperature and, thereafter, the ingot is heated in a furnace followed by hot shaping. (The term "JP-B" used herein means an examined Japanese patent publication.)

The transversal cracking of ingots is caused either by the extreme coarsening of columnar crystals in the cast structure of the ingot surface layer during heating, or by the fracture which occurs during primary rolling in the surface area of the ingot which has become brittle due to the oxidation of the grain boundaries of austenite crystals in the surface area. Noting the above facts, in the method of JP-B-49-7771, only the surface layer of the ingot is quenched, so that its columnar crystallographic structure is divided into fine portions while the grains of austenite crystals which form in subsequent heating are refined.

In the case of aluminum killed steels, dissolved aluminum binds with the nitrogen in the steel to form aluminum nitride. If its production exceeds the solubility limit in the course of temperature drop following the solidification of the ingot, the aluminum nitride is deposited as a tabular precipitate at austenite grain boundaries, eventually causing surface cracking. Under the circumstances, the surface layer of the ingot is quenched so that the precipitation of aluminum nitride at austenite grain boundaries is sufficiently suppressed to prevent transferal cracking.

The method described in JP-B-49-7771 is very effective in the case of producing steel ingots with ordinary molds, since the surface temperature of the ingot for starting the quenching can be freely selected so that it can be quenched from comparatively high temperatures. However, this is not the case for producing blooms by a continuous casting machine. When molten steel comes into contact with a water-cooled mold, the cooling action of the mold causes a thin solidified skin to form on the surface. In order to prevent the solidified skin from rupturing caused by withdrawing the casting from the mold by means of pinch rolls which are positioned below, the cast bloom must be cooled more rapidly than the ordinary ingots. Therefore, in the process of continuous casting, the temperature difference between the surface and the interior of the casting is so great as to increase the chance of the occurrence of strains such as transformational strains. In addition, strain due to the ferrostatic pressure of molten steel and the external strain caused by straightening rolls will also act on the continuous-cast bloom, thereby causing cracks to develop more frequently than in the case of the ordinary cast ingots. Under the circumstances, the continuous casting process requires positive cooling of the surface of a solidifying steel bloom but its temperature thus drops just above the $Ar_3$ point, which has made it impossible to fully attain the advantages of the method described in JP-B-49-7771.

JP-A-63-168260 proposes a method for solving the aforementioned problems associated with the production of blooms by a continuous casting machine. (The term "JP-A" as used herein means an unexamined published Japanese patent application.) JP-A-63-168260 discloses a method of hot working a continuous-cast bloom, in which a killed steel bloom produced by continuous casting is first cooled to bring its surface temperature to 150° to 50° C. higher than the $Ar_3$ transformation point, then quenched with a cooling medium in such a way that the interior of the bloom remains red hot while the surface temperature becomes 100° to 400° C. lower than the $Ar_1$ transformation point and, thereafter, the bloom is cut to predetermined lengths, which are subsequently heated in a furnace followed by hot shaping.

This method is characterized in that when the bloom immediately after cast in a continuous uncut form is still hot on the surface and has a specified surface temperature higher than the $Ar_3$ transformation point where the bloom is solely composed of an austenite structure, the surface layer of the bloom is quenched by a suitable method such as water spraying. This method is capable of effectively suppressing the surface cracking that develops in continuous-cast blooms.

Recently, in order to prevent the coarsening of crystal grains during carburization, low-alloy steels and low-carbon steels that are especially adapted for carburization through positive addition of nitrogen have recently come to be produced in increased quantities. These steels generally contain from 0.0080 to 0.0300% by weight of nitrogen to have high aluminum nitride contents, and therefore they are highly susceptible to cracking at elevated temperatures and have suffered from the problem of frequent surface cracking during hot working.

Furthermore, with the recent increase in demand for steels of good cuttability, free-cutting steels containing lead have come to be produced in increased quantities. Such steels generally contain from 0.03 to 0.25% by weight of lead, and since the lead causes adverse effects on hot workability at elevated temperatures, they suffer from the same problems as the nitrogen-containing steels and experience frequent surface cracking during hot working.

The above two prior art methods described in JP-B-49-7771 and JP-A-63-168260 have proved to be very effective for the purpose of suppressing the occurrence of surface cracking in many species of steels. However, they are not as effective on the nitrogen- or lead-containing steels which have seen increasing use these days and a need has arisen to develop an improved production process.

SUMMARY OF THE INVENTION

An object of the present invention is to provide a process for hot working continuous-cast blooms or steel ingots by which the occurrence of surface cracking can be effectively suppressed. Particularly, in an aluminum killed steels, the occurrence of surface cracking can be effectively suppressed, even if they contain from 0.0080 to 0.0300% by weight of nitrogen and/or from 0.03 to 0.25% by weight of lead.

Other objects and effects of the present invention will be apparent from the following description.

The present invention relates to a process for hot working a continuous-cast bloom or a steel ingot, the process comprising the steps of:

(1) cooling a bloom produced by continuous casting or a steel ingot produced with a mold to bring the surface temperature thereof to 50° to 150° C. higher than the $Ar_3$ transformation point thereof;

(2) quenching the bloom or the steel ingot in such a way that its interior remains red hot while the surface area is transformed to have a bainite structure; and (3) heating the bloom or the steel ingot in a furnace followed by hot shaping.

The species of steels, to which the present invention is applied, is not limited, but the present invention is particularly advantageous if it is applied to an aluminum killed steel containing from 0.03 to 0.25% by weight of lead, an aluminum killed steel containing from 0.0080 to 0.0300% by weight of nitrogen, or an aluminum killed steel containing from 0.03 to 0.25% by weight of lead and from 0.0080 to 0.0300% by weight of nitrogen.

DETAILED DESCRIPTION OF THE INVENTION

Figure 1:
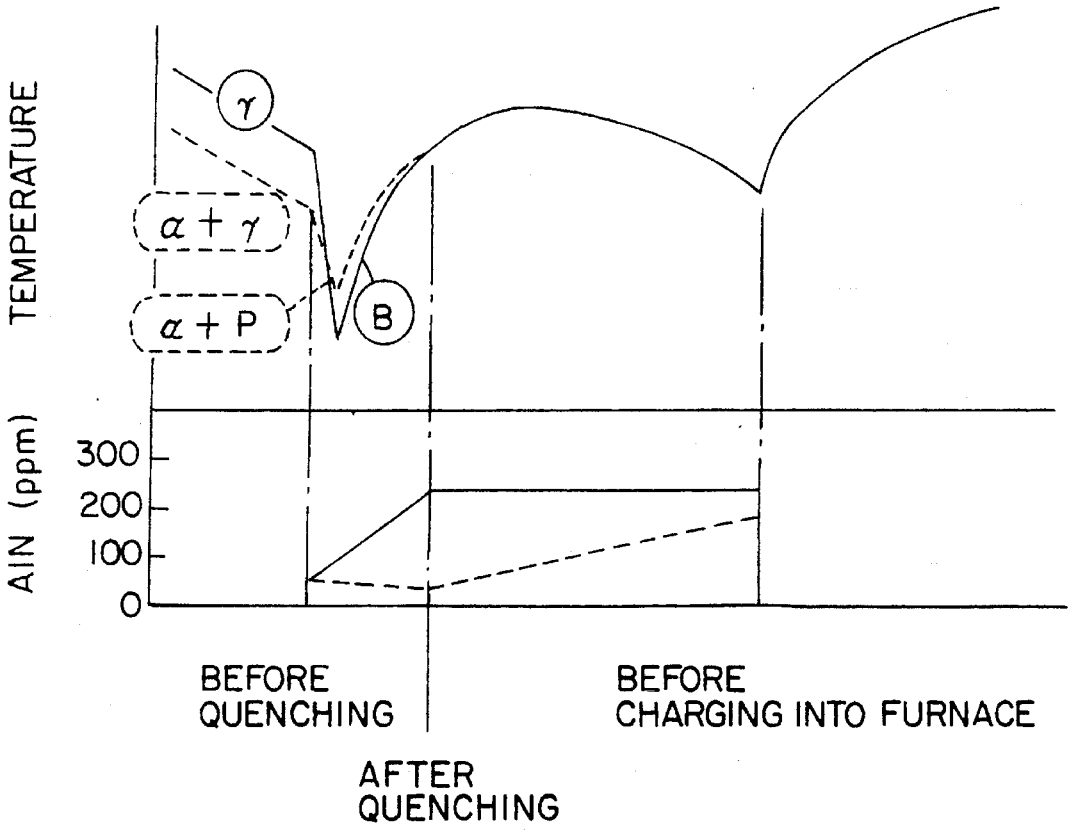
FIG. 1 is a diagram showing the history of the surface temperature of a continuous-cast aluminum-killed Cr steel bloom and the change in the amount of aluminum nitride in the surface layer of the steel bloom.

The present inventors have made structure-oriented investigations on the problems associated with the prior art methods of suppressing surface cracking and conducted numerous experiments. As a result, the inventors have obtained the following observations which are the basis for the accomplishment of the present invention.

In the prior art, quenching with a cooling medium was the only factor that was considered to prevent the deposition of aluminum nitride at austenite grain boundaries, and the studies conducted were not far-reaching enough to unravel the relationship between the structure of a cooled steel and the profile of surface cracking.

Under these circumstances, the present inventors have conducted experiments with steel specimens being cooled under various conditions so as to evaluate the effects of their structure on surface cracking. As a result, the inventors have found that a significant surface crack suppressing effect is attained when the surface layer of the steel is cooled to produce a bainite structure. More specifically, bainite transformation is different from ferrite/pearlite transformation in that the bainite transformation is diffusionless transformation; therefore, when reheating occurs in the subsequent stage on account of heat conduction from the red-hot interior of the steel, aluminum nitride is precipitated within the grains in a uniform and refined manner. As a result, aluminum nitride is difficult to be precipitated at grain boundaries in the subsequent step of heating in a furnace, thereby effectively preventing the decrease in hot workability due to the deposition of aluminum nitride at grain boundaries.

The present invention has been accomplished on the basis of these concepts.

FIG. 1 is a diagram showing the history of the surface temperature of continuous-cast aluminum-killed Cr steel blooms and the change in the amount of aluminum nitride in the surface layer of the steel. In FIG. 1, the solid lines refer to the case where the structure of the surface layer is transformed to a bainite structure upon quenching, and the dashed lines refer to the case where the surface layer is transformed to a ferrite/pearlite structure upon quenching.

In the present invention, the temperature at which the quenching of the steel bloom or ingot starts is limited to the specified range for the following reasons: If the surface temperature of the steel bloom or ingot is more than 150° C. higher than the $Ar_3$ transformation point thereof, the temperature difference between the inside and surface areas becomes so great that it is difficult to have the surface area transformed completely to have a bainite structure. If the surface temperature drops to less than 50° C. higher than the $Ar_3$ transformation point, partial precipitation of ferrite starts to occur and subsequent quenching is incapable of producing a complete bainite structure.

The term "$Ar_3$ transformation point" used herein means the transformation temperature that is estimated by calculation based on the composition of the steel. The actual transformation temperature varies with the cooling rate and other factors and, hence, in order to prevent the precipitation of ferrite, quenching must be started at a temperature at least 50° C. higher than the estimated transformation point.

Continuous-cast blooms must be withdrawn from the mold without rupturing the solidified skin, and at the same time, it is necessary to achieve satisfactory segregation through the center of the cast bloom. To meet these requirements, the casting speed cannot be made faster than a certain level and the prior art methods have encountered a problem that the temperature at which the quenching of cut blooms is started drops to just above the $Ar_3$ transformation point. However, the recent advances in continuous casting technology including the optimization of operating conditions and the installation of an induction stirrer within the mold have made it possible to perform high-speed casting operations, and even in the case of continuous-cast blooms that have been cut to predetermined lengths, quenching can be started at temperatures within the range specified by the present invention. It should, however, be noted that the cutting step may follow the step of quenching the surface layer of the continuous-cast bloom, i.e., the order of the cutting and quenching steps is not critical to the present invention.

In order to produce the desired bainite structure, cooling to an adequately low temperature and quenching at an adequately fast speed are important requirements for the present invention. An optimum temperature for ending the quenching step varies with the species of steels. For example, in the case of an aluminum killed chromium (Cr) steel specified in JIS G4104 containing from 0.13 to 0.48% by weight of carbon, from 0.90 to 1.20% by weight of chromium, from 0.15 to 0.35% by weight of silicon, and from 0.60 to 0.85% by weight of manganese, quenching must be accomplished such that the surface temperature is lowered to 250° C. or less. In the case of an aluminum killed chromium-molybdenum (Cr—Mo) steel specified in JIS G4105 containing from 0.13 to 0.48% by weight of carbon, from 0.90 to 1.20% by weight of chromium, from 0.15 to 0.30% by weight of molybdenum, from 0.15 to 0.35% by weight of silicon, and from 0.60 to 0.85% by weight of manganese, quenching must be accomplished such that the surface temperature is lowered to 280° C. or less. The temperature for ending the quenching step as referred herein means the quench end temperature on the surface and, hence, the quench end temperature in the surface layer somewhat deeper inside is higher than that temperature on the surface.

An optimum surface cooling rate (quench rate) for attaining a bainite structure also varies with the species of steels. For example, in the case of an aluminum killed Cr steel (JIS G4104), transformation to a bainite structure occurs if the surface cooling rate is 2.5° C./sec and higher. In the case of an aluminum killed Cr—Mo steel (JIS G4105), transformation to a bainite structure occurs if the surface cooling rate is 2.0° C./sec and higher. The term "surface cooling rate" as used herein means the difference between the quench start temperature and the quench end temperature, divided by the quench time.

While the above two steel species have been exemplified to describe the present invention, the present invention is not construed as being limited to these steel species.

Any cooling medium may be used to achieve quenching, and water is preferred for various reasons including high cooling performance and low cost. Quenching may be accomplished by any methods, such as immersion in a circulating cooling medium in a vessel and propelling water against the surface of a continuous-cast bloom or steel ingot.

In accordance with the present invention, a continuous-cast bloom or a steel ingot is first cooled to bring its surface temperature to 50° to 150° C. higher than the $Ar_3$ transformation point, and it is then quenched in such a way that its interior remains red hot while the surface area is transformed to have a bainite structure. As a result, when the surface area of the bloom or ingot is reheated by heat conduction from the red-hot interior, aluminum nitride is precipitated within grains in a uniform and refined manner. Therefore, the precipitation of aluminum nitride at austenite grain boundaries in the subsequent step of heating in a furnace is effectively suppressed to effectively reduce surface cracking.

The present invention will be described in more detail by referring to the following examples, but the present invention is not construed as being limited to the examples.

EXAMPLES

The chemical composition of the steels used in Examples are shown in Table 1 below.

TABLE 1

| | (% by weight) | | | | | | |
|---|---|---|---|---|---|---|---|
| Steel | C | Si | Mn | Cr | Mo | Pb | N |
| A | 0.21 | 0.25 | 0.75 | 1.10 | — | — | 0.0136 |
| B | 0.18 | 0.23 | 0.77 | 1.08 | — | 0.20 | 0.0073 |
| C | 0.20 | 0.24 | 0.76 | 1.07 | 0.28 | 0.11 | 0.0100 |

Steel A was a chromium alloy steel (JIS-SCr 420) added with 0.0136% by weight of nitrogen; steel B was a chromium alloy steel (JIS-SCr 420) added with 0.20% by weight of lead; and steel C was a chromium-molybdenum alloy steel (JIS-SCM 420) added with 0.11% by weight of lead and 0.0100% by weight of nitrogen.

The steels of the compositions listed in Table 1 were melted in an electric furnace and deoxidized with aluminum, and they were subjected to an experiment in the following manner. In order to prevent the coarsening of crystal grains during carburization, Steels A and C were positively supplemented with nitrogen in addition to the nitrogen as supplied from the atmosphere. Steels A and B each had the $Ar_3$ transformation point at 780° C., and Steel C had the $Ar_3$ transformation point at 790° C.

The molten steels were poured into the mold of a bending continuous casting machine and the cast blooms were withdrawn from the mold by means of pinch rolls located below. The withdrawn blooms were cut to predetermined lengths and immersed in a tank filled with circulating water to attain quenching. During the quenching by immersion in water, the amount of water circulated was from 3,000 to 3,800 l/min. Immediately after the quenching, the blooms were charged into a heating furnace, and they were heated to a predetermined temperature. Thereafter, the blooms were rolled into billets of a square cross section (160 mm×160 mm with a length of 12,000 mm). These billets were checked for surface cracks. The results are shown in Table 2.

The term "percent crack length" used in Table 2 means the ratio in percentage of the total crack length to the length of the billet. The data of percent crack length are shown in Table 2 as classified by depth for each steel species.

Sample Nos. 1 to 3 are invention examples that satisfied all conditions of the present invention, and Sample Nos. 4 to 10 are comparative examples that did not satisfy one of the conditions of the invention. In Sample Nos. 4 to 6, the quench end temperature was so high as to produce structures that did not comply with the invention; in Sample No. 10, the surface quench rate was so small as to produce a structure that also did not comply with the invention; and in Sample Nos. 7 to 9, the quench start temperature was too low to satisfy the condition specified by the invention.

The structures identified in Table 2 refer to those of the quenched blooms which were examined on specimens cut from the surface areas of the blooms that had been air cooled to room temperature after immersion in the water tank. If the bloom immediately after quenching has a bainite structure, reheating during subsequent air cooling permits it to be examined as a tempered bainite structure.

TABLE 2

| | Example | | | Comparative Example | | | | | | |
|---|---|---|---|---|---|---|---|---|---|---|
| | Sample No. | | | | | | | | | |
| | 1 | 2 | 3 | 4 | 5 | 6 | 7 | 8 | 9 | 10 |
| Steel type | A | B | C | A | B | C | A | B | C | C |
| Quench start temp. (°C.) | 920 | 920 | 920 | 920 | 920 | 920 | 800 | 800 | 800 | 920 |
| Quench end temp. (°C.) | 240 | 240 | 250 | 470 | 470 | 480 | 240 | 240 | 250 | 250 |
| Surface quench rate (°C./sec.) | 2.6 | 3.0 | 2.3 | 2.7 | 2.8 | 2.2 | 2.8 | 2.6 | 2.3 | 1.7 |
| Structure* | B | B | B | α + P | α + P | α + P | α + B | α + B | α + B | α + P |
| Percent crack length | | | | | | | | | | |
| Crack length | | | | | | | | | | |
| >1 mm | 0 | 0 | 0 | 0.07 | 0.05 | 0.06 | 0.06 | 0.02 | 0.05 | 0.02 |
| 0.5–1 mm | 0 | 0.02 | 0.03 | 0.71 | 0.62 | 0.75 | 0.64 | 0.61 | 0.70 | 0.60 |
| <0.5 mm | 0.27 | 0.35 | 0.40 | 1.30 | 1.59 | 1.80 | 1.03 | 1.45 | 1.46 | 1.35 |

*Note α: ferrite; P: pearlite; B: bainite

It is understood from Table 2 that: Sample Nos. 4 to 6 had a ferrite/pearlite structure because of the high quench end temperatures, and they contained numerous surface cracks with a depth of about 1 to 2 mm. Sample No. 10 had a ferrite/pearlite structure because of the small quench rate, and it experienced the development of numerous surface cracks. In Sample Nos. 7 to 9, transformation to bainite occurred together with partial formation of proeutectoid ferrite because of the low quench start temperature, resulting in that it was impossible to achieve satisfactory suppression of surface cracking even when the quench end temperature was set to the same values as in the invention examples.

In contrast, Sample Nos. 1 to 3 satisfying the conditions of the present invention were found to be capable of effectively suppressing the surface cracking.

The same steel species as used in Sample Nos. 1 to 10 above were melted and poured into a mold to cast ingots each having a weight of 2.6 t, which were then subjected to an experiment under entirely the same conditions as in Sample Nos. 1 to 10. The results were substantially the same as those of Sample Nos. 1 to 10.

The foregoing description of the examples concerns the case where the process of the present invention is applied to those steel species which are highly susceptible to surface cracking, i.e., chromium alloy steel and chromium-molybdenum steel as supplemented with lead and/or nitrogen. While these steel species are especially selected in order to demonstrate the advantages of the present invention, equally good results can be attained by applying the present invention to other aluminum-deoxidized carbon steels and alloy steels.

According to the process of the present invention, a bloom produced by continuous casting or a steel ingot produced with a mold is first cooled to bring its surface temperature to 50° to 150° C. higher than the $Ar_3$ transformation point, and it is quenched in such a way that its interior remains red hot while the surface is transferred to have a bainite structure. As a result, aluminum nitride is precipitated within grains in a uniform and refined manner. Therefore, the precipitation of aluminum nitride at austenite grain boundaries in the subsequent step of heating in a furnace is effectively suppressed to reduce the formation of surface cracking. Consequently, the process of the present invention proves to be very effective in suppressing the development of surface cracks even when it is applied to those steels which are highly susceptible to surface cracking, such as steels supplemented by positive addition of nitrogen for preventing the coarsening of crystal grains during carburization and lead-containing steels.

While the invention has been described in detail and with reference to specific embodiments thereof, it will be apparent to one skilled in the art that various changes and modifications can be made therein without departing from the spirit and scope thereof.

What is claimed is:

1. A process for hot working a continuous-cast bloom or a steel ingot, said process comprising the steps of:

(1) cooling a bloom produced by continuous casting or a steel ingot produced with a mold to bring the surface temperature thereof to 50° to 150° C. higher than the $Ar_3$ transformation point thereof;

(2) quenching said bloom or said steel ingot in such a way that its interior remains red hot while the surface is transformed to have a bainite structure; and (3) heating said bloom or said steel ingot in a furnace followed by hot shaping.

2. A process as claimed in claim 1, wherein said continuous-cast bloom or said steel ingot is selected from the group consisting of an aluminum killed steel containing from 0.03 to 0.25% by weight of lead, an aluminum killed steel containing from 0.0080 to 0.0300% by weight of nitrogen, and an aluminum killed steel containing from 0.03 to 0.25% by weight of lead and from 0.0080 to 0.0300% by weight of nitrogen.

3. A process as claimed in claim 1, wherein said continuous-cast bloom or said steel ingot is an aluminum killed Cr-Mo steel containing from 0.13 to 0.48% by weight of carbon, from 0.90 to 1.20% by weight of chromium, from 0.15 to 0.30% by weight of molybdenum, from 0.15 to 0.35% by weight of silicon, and from 0.60 to 0.85% by weight of manganese, and said process comprises the steps of:

(1) cooling said bloom or said steel ingot to bring the surface temperature thereof to 50° to 150° C. higher than the $Ar_3$ transformation point thereof;

(2) quenching only the surface of said bloom or said steel ingot in such a way that its interior remains red hot while the surface is transformed to have a bainite structure, in which the surface cooling rate is at least 2.0° C./sec, and the surface temperature thereof is lowered to 280° C. or less; and (3) heating said bloom or said steel ingot in a furnace followed by hot shaping.

4. A process as claimed in claim 1, wherein said continuous-cast bloom or said steel ingot is an aluminum killed Cr steel containing from 0.13 to 0.48% by weight of carbon, from 0.90 to 1.20% by weight of chromium, from 0.15 to 0.35% by weight of silicon, and from 0.60 to 0.85% by weight of manganese, and said process comprises the steps of:

(1) cooling said bloom or said steel ingot to bring the surface temperature thereof to 50° to 150° C. higher than the $Ar_3$ transformation point thereof;

(2) quenching only the surface of said bloom or said steel ingot in such a way that its interior remains red hot while the surface is transformed to have a bainite structure, in which the surface cooling rate is at least 2.5° C./sec, and the surface temperature thereof is lowered to 250° C. or less; and (3) heating said bloom or said steel ingot in a furnace followed by hot shaping.

* * * * *